US010273040B2

(12) United States Patent
Allen et al.

(10) Patent No.: US 10,273,040 B2
(45) Date of Patent: Apr. 30, 2019

(54) STOCKING TOPPER

(71) Applicant: American Greetings Corporation, Cleveland, OH (US)

(72) Inventors: Keith Allen, Olmsted Falls, OH (US); Tim Walker, Stow, OH (US)

(73) Assignee: American Greetings Corporation, Cleveland, OH (US)

( * ) Notice: Subject to any disclaimer, the term of this patent is extended or adjusted under 35 U.S.C. 154(b) by 16 days.

(21) Appl. No.: 15/692,922

(22) Filed: Aug. 31, 2017

(65) Prior Publication Data

US 2018/0065773 A1 Mar. 8, 2018

Related U.S. Application Data

(60) Provisional application No. 62/384,884, filed on Sep. 8, 2016.

(51) Int. Cl.

| | |
|---|---|
| ***B65D 5/42*** | (2006.01) |
| ***A47G 33/00*** | (2006.01) |
| ***B65D 5/20*** | (2006.01) |
| ***B65D 21/02*** | (2006.01) |
| ***B65D 5/18*** | (2006.01) |

(52) U.S. Cl.

CPC ..... *B65D 5/425* (2013.01); *A47G 33/00* (2013.01); *B65D 5/18* (2013.01); *B65D 5/20* (2013.01); *B65D 5/4266* (2013.01); *B65D 21/0233* (2013.01)

(58) Field of Classification Search

USPC ..... 206/457

See application file for complete search history.

(56) References Cited

U.S. PATENT DOCUMENTS

| | | | | | |
|---|---|---|---|---|---|
| 1,866,241 | A * | 7/1932 | Vineberg | A47G 25/54 | 206/287 |
| 2,069,738 | A * | 2/1937 | Buchen | B65D 25/525 | 222/531 |
| 2,358,859 | A * | 9/1944 | Hauton | A47F 5/112 | 206/45.25 |
| 2,456,735 | A * | 12/1948 | Roselle | B65D 5/741 | 222/566 |
| 4,969,821 | A * | 11/1990 | Smith | G09B 19/00 | 434/433 |
| 5,458,932 | A * | 10/1995 | Zinbarg | A63H 3/06 | 206/457 |
| 5,613,312 | A * | 3/1997 | Crowell | A45C 13/08 | 206/457 |
| 8,469,220 | B2 * | 6/2013 | Van Fleet | G01G 19/52 | 177/238 |
| 2007/0007167 | A1 * | 1/2007 | Petter | B65D 5/4245 | 206/768 |
| 2011/0031369 | A1 * | 2/2011 | Kacines | A47G 33/04 | 248/344 |
| 2011/0097964 | A1 * | 4/2011 | Law | A63H 13/00 | 446/72 |

(Continued)

*Primary Examiner* — Jacob K Ackun

(74) *Attorney, Agent, or Firm* — Christine Flanagan

(57) ABSTRACT

A stocking topper having components which are combined to form an insert to be placed into or atop an open topped container, such as a Christmas stocking. The stocking topper provides a receptacle into which various items can be inserted such that they will be positioned in an upper area of a stocking while also providing entertaining visual features.

11 Claims, 5 Drawing Sheets

(56) References Cited

U.S. PATENT DOCUMENTS

| | | | | |
|---|---|---|---|---|
| 2012/0071060 | A1* | 3/2012 | Cannon | A63H 3/50<br>446/73 |
| 2013/0045659 | A1* | 2/2013 | Tobias | A63H 3/48<br>446/376 |
| 2013/0102219 | A1* | 4/2013 | Laiken | B42D 15/042<br>446/73 |
| 2013/0277246 | A1 | 10/2013 | Glass et al. | |
| 2014/0097122 | A1* | 4/2014 | Patterson | B65D 5/5226<br>206/758 |

* cited by examiner

STOCKING TOPPER

RELATED APPLICATIONS

This application is a non-provisional of and claims priority to U.S. Provisional Patent Application No. 62/384,884, filed on Sep. 8, 2017, a copy of which is incorporated herein by reference in its entirety.

FIELD OF THE INVENTION

The present invention is in the field of social expression products, and more specifically to an insert that can be placed into a Christmas stocking.

SUMMARY OF THE INVENTION

The stocking topper of the present disclosure and related inventions includes components which can be assembled to form an insert to be placed into or atop an open topped container, such as a Christmas stocking. The stocking topper provides a receptacle into which various items can be inserted and contained within an upper portion of a stocking while also providing entertaining visual features.

DETAILED DESCRIPTION OF PREFERRED AND ALTERNATE EMBODIMENTS

The stocking topper of the present disclosure and related inventions includes components which are combined to form a novel insert for an opened topped container, such as a Christmas stocking. The stocking topper can be neatly folded for easy transport and display at retail and then easily constructed by a consumer after purchase.

Figure 4:
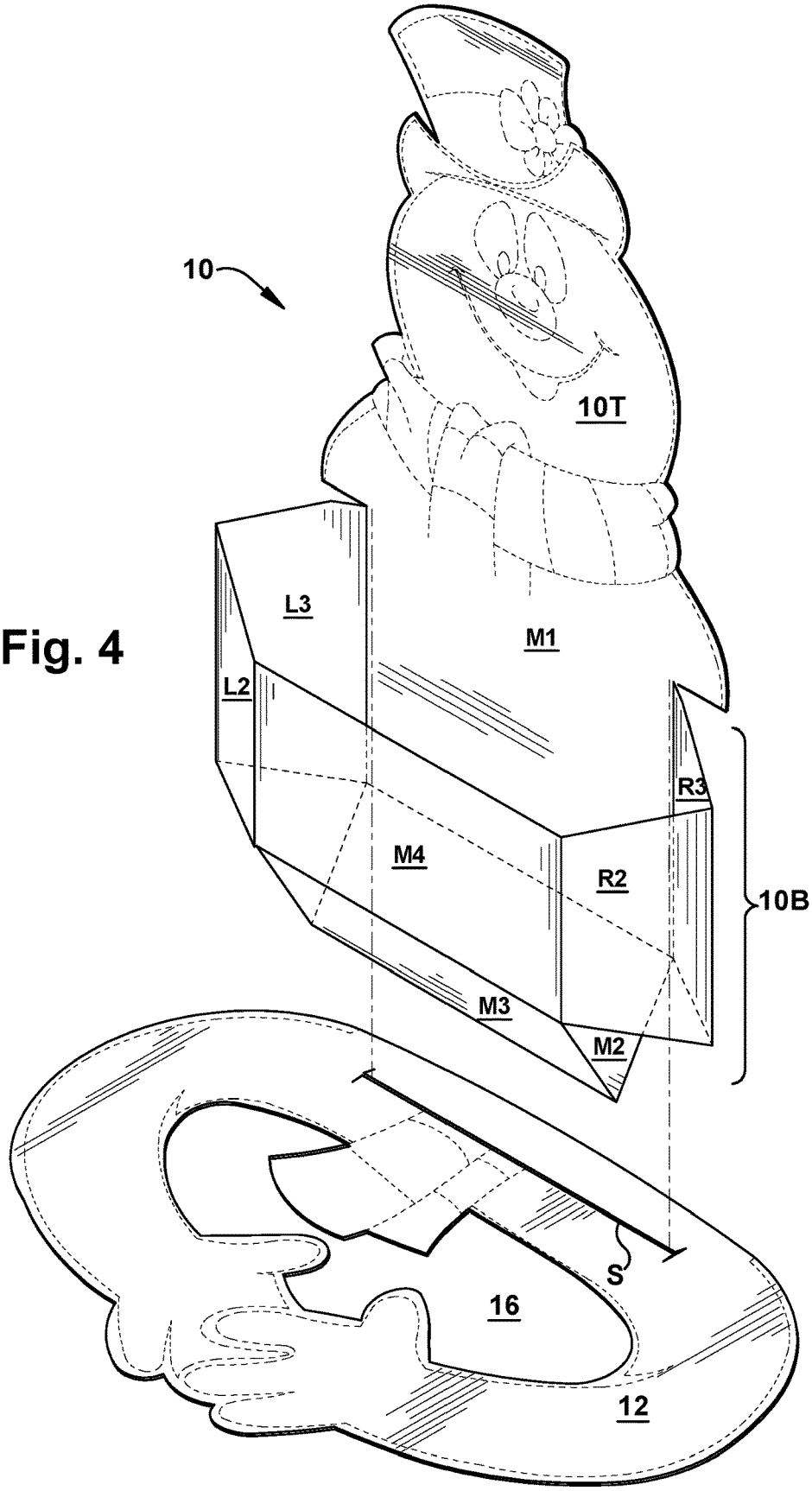
FIG. 4 is an exploded view of the stocking topper of FIG. 3.
Figure 5:
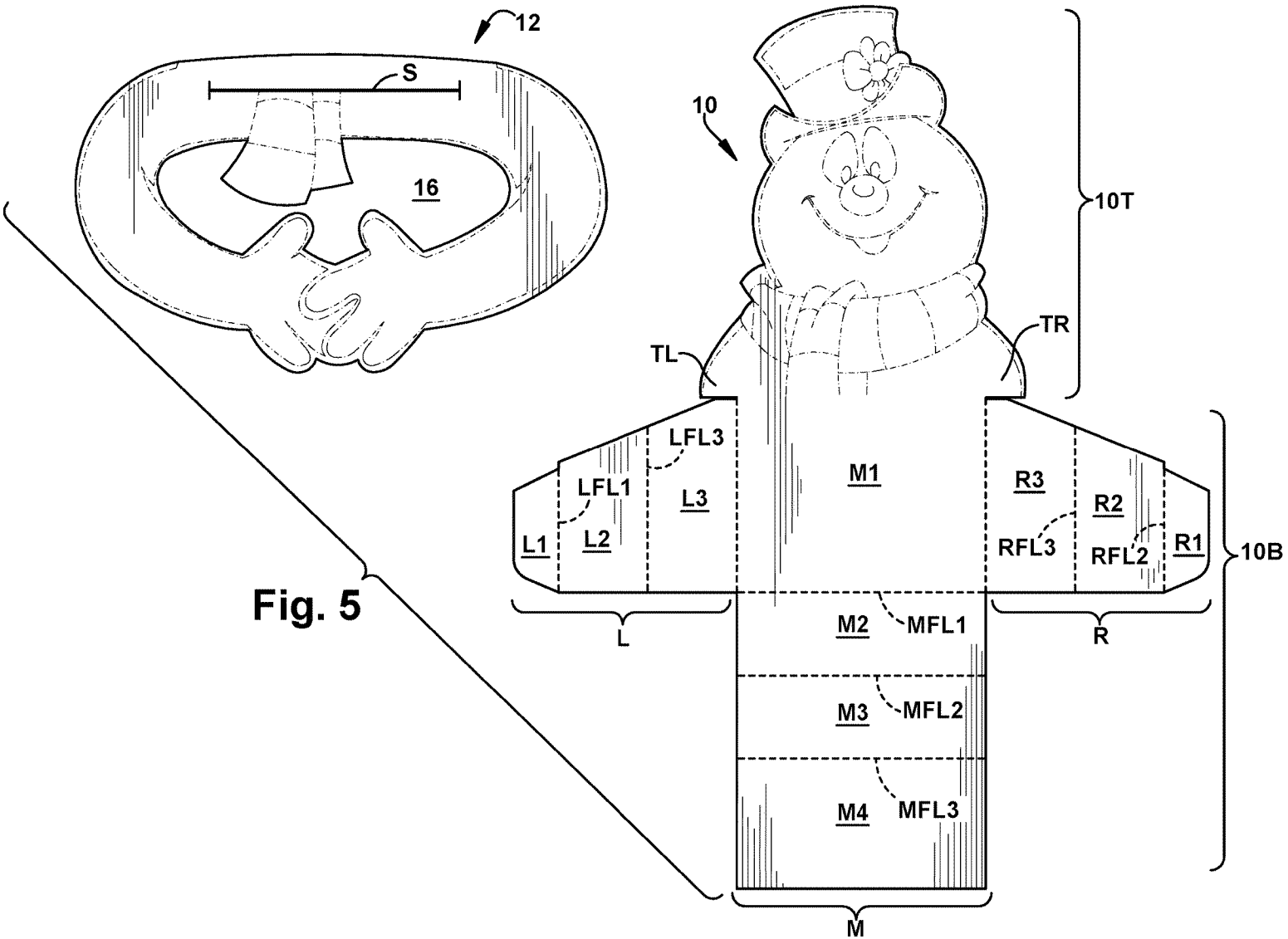
FIG. 5 is a front view of the stocking topper of FIG. 3, in an unassembled state.

In one embodiment, the stocking topper 100 includes two separate components—a base portion 10 and a lip portion 12, as shown in FIGS. 4 and 5. The base portion 10 serves as the main body of the stocking topper 100 and the lip portion 12 serves as a stopper or shelf which allows the stocking topper 100 to sit atop an open topped container 14 and not slide down into said container 14. The base portion 10 comes in a disassembled state, as shown in FIG. 5, and must be assembled by the purchaser. In one embodiment, the base 10 and lip 12 portions of the stocking topper 100 are both made of paperboard, although other materials may be used and the materials used for the base 10 and lip 12 may be different.

Figure 2:
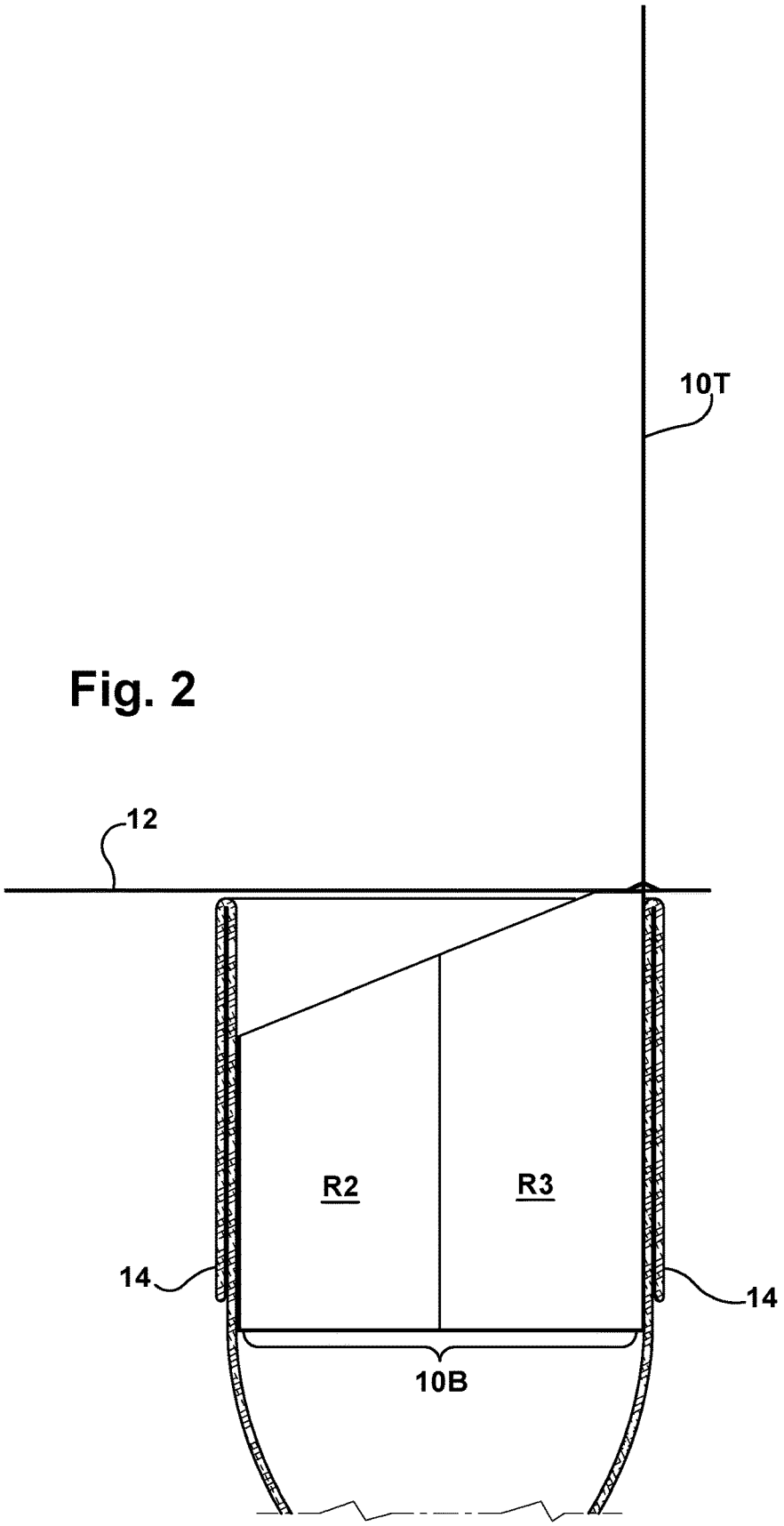
FIG. 2 is a right side cross-sectional view of the stocking topper.
Figure 3:
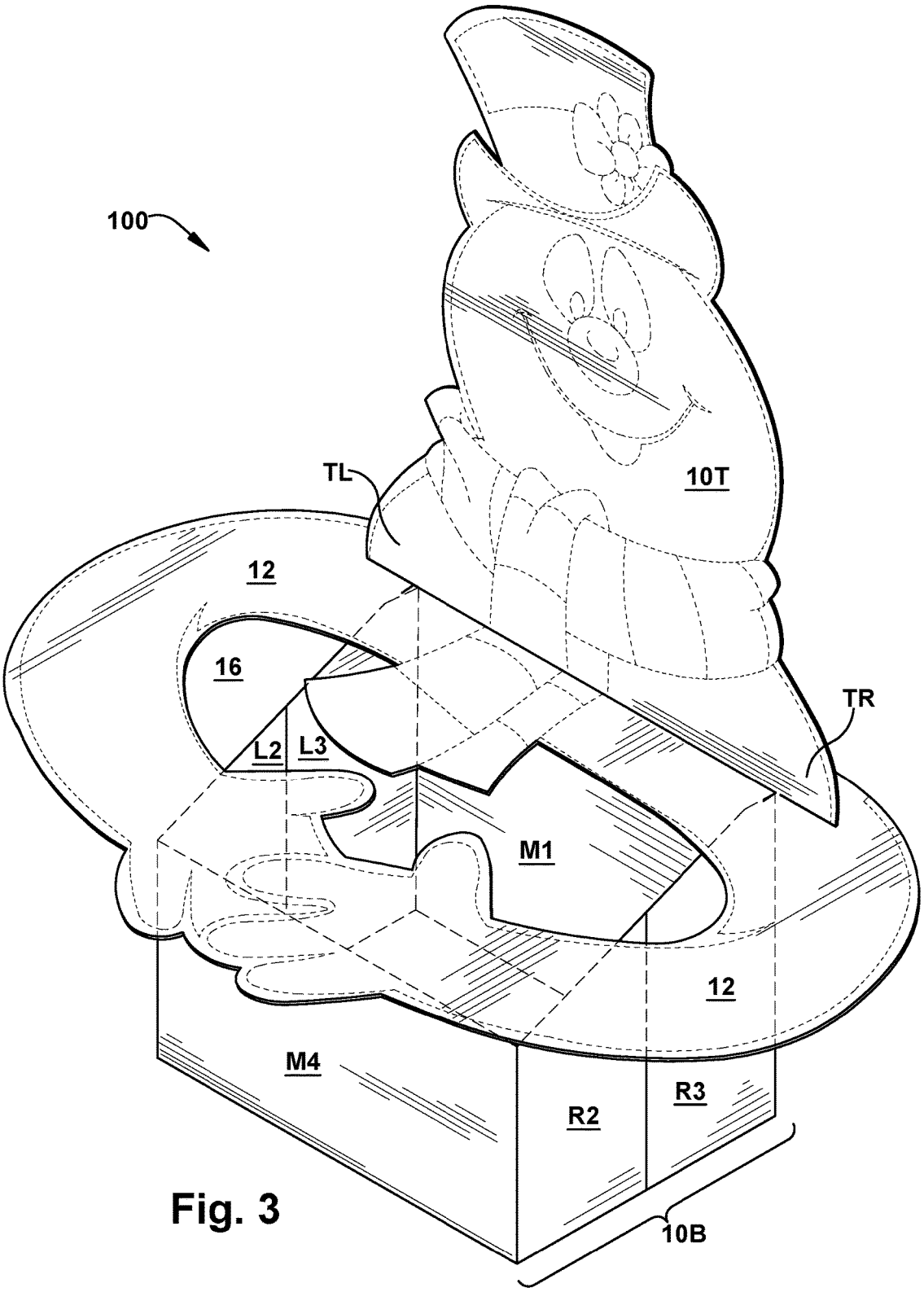
FIG. 3 is a perspective view of the stocking topper.

The base portion 10, in an unassembled state, as shown in FIG. 5, resembles a plus sign or cross, having an upper or top section 10T and a lower or bottom section 10B. The bottom section 10B includes a right section R, a left section L and a midsection M. The midsection M contains four subsections. A first sub-midsection M1 is connected to a second sub-midsection M2 along a first midsection horizontal fold line MFL1. The second sub-midsection M2 is connected to a third sub-midsection M3 along a second midsection horizontal fold line MFL2. The third sub-midsection M3 is connected to a fourth sub-midsection M4 along a third midsection fold line MFL3. The right and left sections R, L each contain three sub-sections. The right section R contains a first right sub-section R1 connected to a second right sub-section R2 along first right vertical fold line RFL1 and the second right sub-section R2 is connected to a third right sub-section R3 along a second right vertical fold line RFL2. The third right sub-section R3 is connected to the first sub-midsection M1 along a third right vertical fold line RFL3. The left section L contains a first left sub-section L1 connected to a second left sub-section L2 along a first left vertical fold line LFL1 and the second left sub-section L2 is connected to a third left sub-section L3 along a second left vertical fold line LFL2. The third left sub-section L3 is connected to the first sub-midsection M1 along a third left vertical fold line LFL3. The top edge of each of the right and left sections R, L are angled away from the first sub-midsection M1 such that the height of each of the right and left sub-sections decreases as you move away from the first sub-midsection M1 with the third right and left sub-sections R3, L3 being taller than the second right and left sub-sections R2, L2 and the second right and left sub-sections R2, L2 being taller than the third right and left sub-sections R3, L3. The upper or top section 10T, in one embodiment, is substantially planar and is shaped like the top or head and shoulders of a character, such as a cartoon character, a movie character, a famous person, or any other person or animal, real or animated. The upper or top section 10T also contains printing thereon in keeping with the character, such as a face, shoulders, or any other feature or clothing item. The upper or top 10T section may contain additional embellishments such as faux fur or hair, googly eyes, etc. For example, as shown in the figures, the upper or top section 10T is shaped and decorated and/or embellished to resemble the upper body of a snowman, with a face, a hat, shoulders and a scarf. The bottom edge of the upper or top section 10T, is partially connected to and contiguous with the first sub-midsection M1, and contains a right TR and left TL excess portion which is not attached to the first sub-midsection M1 and extends over the right and left portions R, L of the base 10. The upper or top T, right R, and left L portions and the midsection M of the base 10 are configured to be folded into an open topped box 10B, having a floor panel, a right side panel, a left side panel, a front panel and a rear panel. The second and third right sub-sections R2, R3 serve as the right side panel of the box 10B. The second and third left sub-sections L2, L3 serve as the left side panel of the box 10B. The second and third sub-midsections M2, M3 serve as the floor panel of the box 10B. The fourth sub-midsection M4 serves as the front panel and the first sub-midsection M1 serves as the rear panel of the box 10B. The box 10B is constructed by folding the second sub-midsection panel M2 along the first sub-midsection fold line MFL1 so that the second, third and fourth sub-midsections M2, M3, M4 are is positioned perpendicularly with respect to the first sub-midsection M1 (also the rear panel of the box). The third right sub-section R3 is folded inward about the third right vertical fold line RFL3 such that the first, second and third right sub-sections R1, R2, R3 are perpendicular to the first sub-midsection M1. The third left sub-section L3 is folded inward about the third left vertical fold line LFL3 such that the first, second and third left sub-sections L1, L2, L3 are perpendicular to the first sub-midsection M1. The fourth sub-midsection M4 is then folded upward along the third horizontal midsection fold line MFL3 such that it is perpendicular to the second and third sub-midsections M2, M3, the first, second and third right subsections R1, R2, R3, and the first, second and third left subsections L1, L2, L3 and parallel to the first sub-midsection M1. The first right sub-section R1 is folded inward along the first right vertical fold line RFL1 and attached to the inside surface of the fourth sub-midsection M4. The first left sub-section L1 is folded inward along the first left vertical fold line LFL1 and attached to the inside surface of the fourth sub-midsection M4. The first right and left sub-sections R1, L1 are attached to the inside surface of the fourth sub-midsection M4 via adhesive or any other attachment mechanism. The inside surface of the fourth sub-midsection M4 may contain two adhesive strips or patches that are initially covered by a paper backing. The paper backing can be removed to reveal the adhesive therebeneath. This creates an open-topped box or cavity 10B into which items may be inserted and removed. As mentioned above, the right and left sections R, L are angled such that the constructed box 10B contains a higher back panel M1 (larger in height than the front panel M4) with right R2, R3 and left L2, L3 side panels which taper or slope downward towards the front panel M4 (smaller in height than the back panel M1) of the box 10B, as shown in FIGS. 2 and 3. In one embodiment, the floor panel M2, M3 of the box 10B is approximately 4-inches by 5-inches and is operative to fit within the opening of a standard adult-sized Christmas stocking or other similarly sized open-topped container 14, as shown in FIGS. 1 and 2.

The lip portion 12 of the stocking topper 100, in one embodiment, is circular or ovoidal with an opening or aperture 16 therethrough. The lip 12 is shaped and printed/decorated/embellished to resemble two arms and hands of a character (as depicted on the upper portion 10T of the stocking topper base 10) in a circular or hugging position. The lip 12 contains a slot S thereon in a rear section thereof. The slot S is approximately as wide as the midsection M or back panel M1 of the box 10B. The bottom edge of the upper or top portion 10T of the base 10 is slightly wider than the slot S so that when the lip 12 is placed over or atop the base 10, the right and left excess or overhang portions TR, TL of the upper or top portion 10T of the base 10 sit or rest atop the upper surface of the lip 12 thereby making a snug or secure fit between the base 10 and the lip 12, as shown in FIGS. 1 and 3. The lower surface or underside of the lip 12 rests atop the assembled box portion 10B of the base 10. When the box portion 10B is placed into an open topped container or stocking 14, the lip 12 prevents the box 10B from falling to the bottom of the container or stocking 14. The box 10B gets inserted inside the container or stocking 14 while the lip 12 and upper or top portion 10T remain outside of the container or stocking 14. In other embodiments, the lip 12 and base 10 portions of the stocking topper 100 may be attached to one another using different methods or attachment mechanisms.

Figure 1:
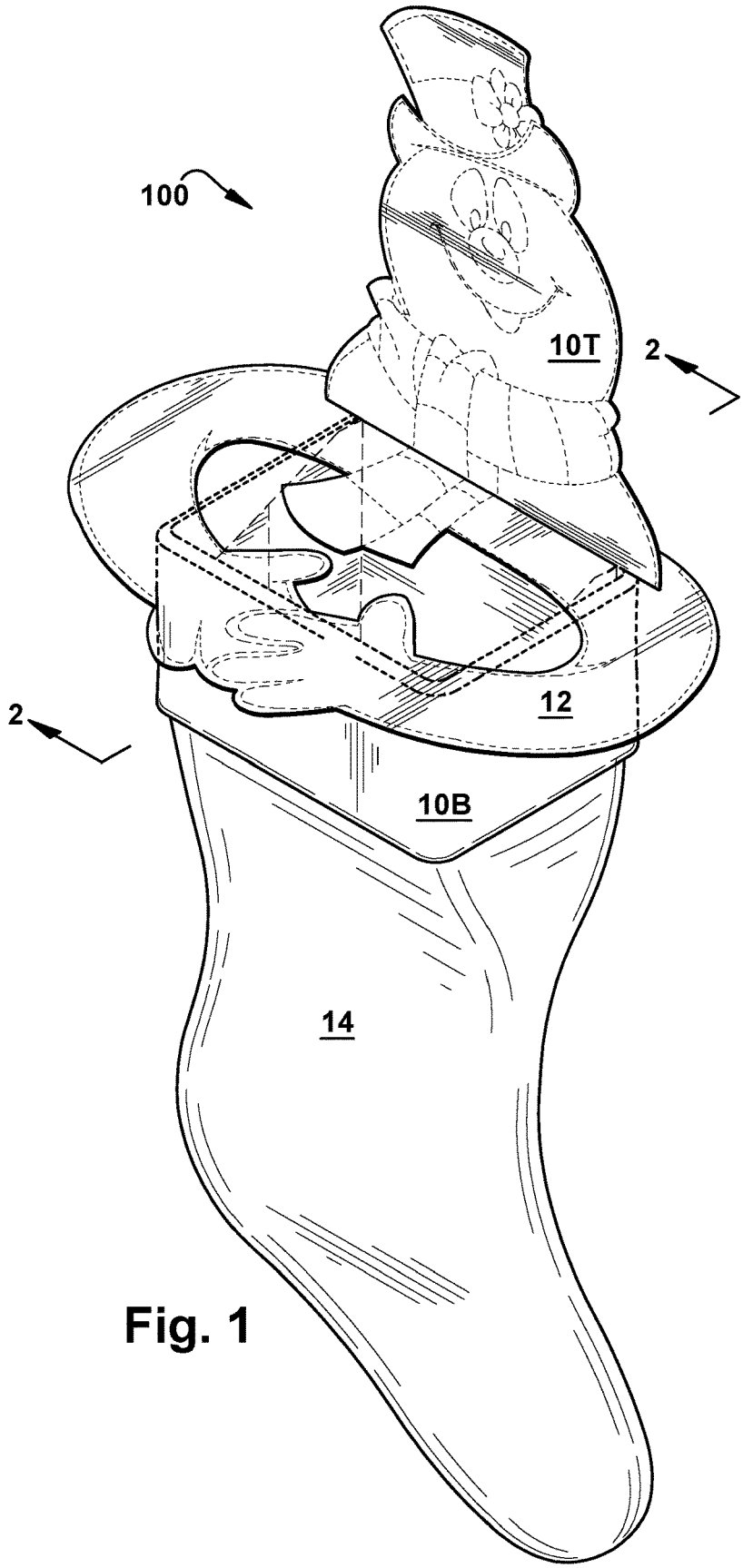
FIG. 1 is a perspective view of the stocking topper of the present invention, as placed inside a Christmas stocking.

Once the stocking topper 100 has been assembled, by constructing the box 10B and inserting the lip 12 over the upper or top portion 10T of the base 10, as described above, the box portion 10B of the base 10 may be inserted into the open top of a container such as a Christmas stocking 14, as shown in FIG. 1. The lip portion 12 of the stocking topper 100 sits atop or over the upper edges of the container 14 opening, thereby preventing the stocking topper 100 from sliding or falling into the container 14. The stocking topper 100 does not require any additional parts, pieces or mechanisms to hold it in place inside the container 14. The box portion 10B of the base 10 is substantially contained and concealed within the container 14 but items inserted into the box 10B may partially extend over the top of the container 14 so that they are visible. The lip portion 12 of the stocking topper 100 is positioned around the opening of the container 14 and the upper or top portion 10T of the base 10 is visible above the lip 12, outside of the container or stocking 14. As noted above, the upper or top portion of the base 10T is shaped and decorated/printed/embellished to resemble the head of a character, such as the snowman, as shown in the figures and the lip portion 12 is shaped and decorated/printed/embellished to resemble the arms and hands of said character or snowman so the overall visual once the stocking topper 100 is placed over and partially into the open top of a container 14 is of the character sitting within the stocking or container 14 with his/her hands hugging or resting around the top edge of the open topped stocking or container 14. The stocking topper 100 allows the user to insert items into and fill the bottom portion or cavity of the stocking 14 while placing additional items into the box portion 10B of the stocking topper 100, which may perhaps be partially visible over the top edge of the open topped container or stocking 14. The items inserted into the box portion 10B may not be visible over the top of a stocking or may be partially or fully visible over the top of the container or stocking 14.

The stocking topper has been described herein and shown in the figures as having two separate and distinct portions (base and lip), however fewer or greater than two portions may be used. For example, the entire stocking topper may be made of a single, contiguous material or there may be three or more separate portions. Also, the stocking topper is described as being made of paperboard, however, other lightweight materials may be used, including but not limited to: paper, cardboard, corrugate, foam, plastic, or other such material. The various portions of the stocking topper may be attached or connected via adhesive, slot and tabs, or via other attachment mechanisms or friction fit methods.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A container insert comprising:

a main body comprising an upper portion attached to a box, the upper portion shaped and printed to resemble the upper body of a character;

a circular or ovoidal portion having an aperture or opening therethrough, the circular or ovoidal portion shaped and printed to resemble the arms and hands of the character;

wherein the circular or ovoidal portion is inserted over the main body to rest between the upper portion and the box.

2. The container insert of claim 1, wherein the box portion of the main body is operative to sit within an open topped container.

3. The container insert of claim 1, wherein the box is open topped.

4. The container insert of claim 1, wherein the at least two sides of the box are tapered downward from back to front.

5. The container insert of claim 1, wherein the upper portion of the main body and the box are contiguous.

6. A stocking topper comprising:

a receptacle having a flat first panel extending upward from at least one side thereof;

a second panel which is inserted over the top of the first panel to rest atop the receptacle and to surround an open top of the receptacle;

wherein the flat first panel is shaped and printed to resemble the upper body of a character; and wherein the second panel is shaped and printed to resemble the arms and hands of the character; and wherein at least a portion of the receptacle is operative to fit within the open end of a stocking.

7. The stocking topper of claim 6, wherein the receptacle is a box.

8. The stocking topper of claim 6, wherein the receptacle has an open top.

9. The stocking topper of claim 6, wherein the second panel is located between the receptacle and the first panel.

10. The stocking topper of claim 6, wherein the second panel is ovoid-shaped with an opening therethrough.

11. The stocking topper of claim 6, wherein the receptacle and the first panel are contiguous.

* * * * *